United States Patent [19]

Ezell

[11] Patent Number: 4,802,355

[45] Date of Patent: Feb. 7, 1989

[54] FLANGE-FORMING TOOL

[76] Inventor: Nelson Ezell, P.O. Box 1793, Breckenridge, Tex. 76024

[21] Appl. No.: 114,614

[22] Filed: Oct. 29, 1987

[51] Int. Cl.[4] ..... B21D 19/02

[52] U.S. Cl. ..... 72/112; 72/379

[58] Field of Search ..... 72/120, 122, 123, 125, 72/379, 70, 71, 215, 216, 411, 105, 109, 111, 112, 67, 74, 126, 113

[56] References Cited

U.S. PATENT DOCUMENTS

| | | | |
|---|---|---|---|
| 4,364 | 1/1846 | Hewes . | |
| 189,870 | 4/1877 | Miller et al. . | |
| 236,285 | 1/1881 | Wilbur | 72/125 |
| 291,620 | 1/1884 | Nugent | 72/111 |
| 341,598 | 5/1886 | O'Brien . | |
| 582,863 | 5/1897 | Jones | 72/111 |
| 1,597,575 | 8/1926 | Bowman | 72/123 |
| 1,656,277 | 1/1928 | Haak et al. | 72/126 |
| 1,670,216 | 5/1928 | Savadow | 72/112 |
| 1,713,940 | 5/1929 | Zang | 72/123 |
| 1,751,085 | 3/1930 | Hopkins | 72/122 |
| 1,830,865 | 11/1931 | Zang | 72/123 |
| 1,855,978 | 4/1932 | Malone | 72/125 |
| 2,124,741 | 7/1938 | Knudsen | 72/109 |
| 2,254,289 | 9/1941 | Jensen | 72/109 |
| 2,840,136 | 6/1958 | Bellarts | 72/125 |
| 3,196,655 | 7/1965 | Hedgecock et al. | 72/101 |

*Primary Examiner*—Lowell A. Larson

*Attorney, Agent, or Firm*—Glaser, Griggs & Schwartz

[57] ABSTRACT

An apparatus and method for forming a conical flange about a circular opening in a malleable sheet material are provided. A plurality of flange-forming members are adapted to engage the circular opening in a material-opposing relationship. The members are then translated about the opening while maintaining the material-opposing relationship and varying the angular positions of the flange-forming members with respect to the material such that the conical flange is formed therein when the members are translated.

20 Claims, 4 Drawing Sheets

FLANGE-FORMING TOOL

TECHNICAL FIELD

The present invention relates to hand tools, and more particularly to a hand tool for forming a conical flange about a circular opening in malleable sheet material.

BACKGROUND OF THE INVENTION

Conical flanges are commonly used to stiffen sheet material in which relatively large circular openings are formed. By way of example, rib and spar members in aircraft frames are often made from sheet aluminum, and large circular "lightening holes" are provided to both lighten the members and provide passageways for control cables, hoses and the like. Conical flanges are formed about the periphery of the openings in order to stiffen the members.

Specialized heavy machinery is used in large-scale manufacturing environments to form the desired conical flanges in sheet material. For example, special fixed-dimension dies may be used in conjunction with a stamping operation to form conical flanges in an efficient and economical manner when relatively numerous operations are contemplated. The need has arisen, however, for a small hand-operated tool for forming conical flanges in small numbers and without specialized, heavy equipment. Such a tool would be useful, for example, in the repairing of aircraft where a single or small number of ribs or spars are to be fabricated at the repair facility. The flange-forming tool should be operable by hand to form a conical flange in a malleable sheet material, and the tool should be adjustable to accommodate openings of varying size and flanges of varying widths, thicknesses and angular displacements, depending on the application.

SUMMARY OF THE INVENTION

The present invention provides an apparatus and method for forming conical flanges about circular openings in malleable sheet material. A plurality of flange-forming members are adapted for engagement with the material about the opening in a material-opposing relationship, and means for translating the flange-forming members about the opening while maintaining the material-opposing relationship are provided. A means for varying the angular positions of the flange-forming members biases the members with respect to the material about the opening, such that a conical flange is formed in the material when the members are translated about the opening.

BRIEF DESCRIPTION OF THE DRAWINGS

For a more complete understanding of the present invention, reference is now made to the following Detailed Description taken in conjunction with the accompanying Drawings in which.

DETAILED DESCRIPTION OF THE PREFERRED EMBODIMENT

Figure 1:
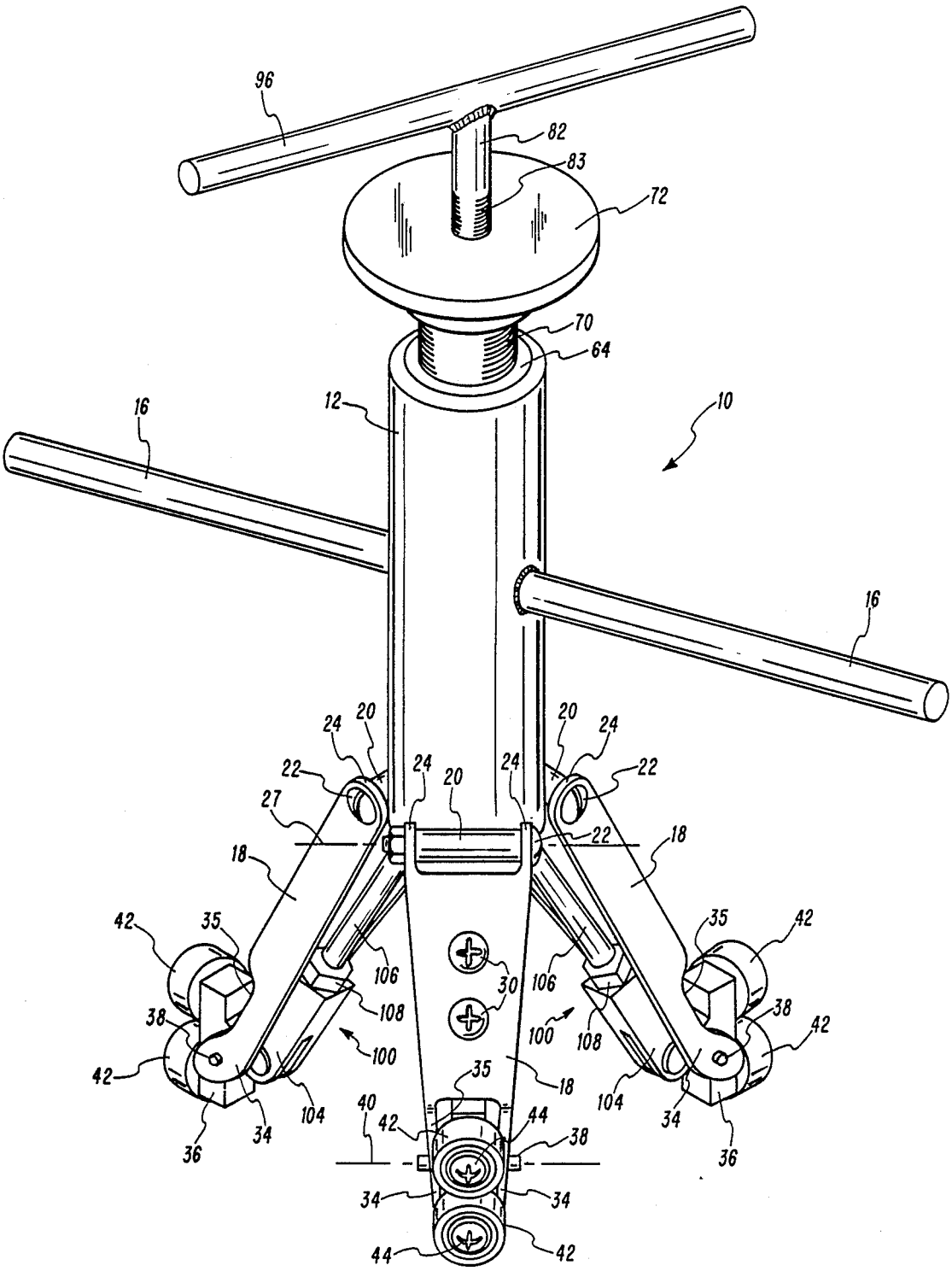
FIG. 1 is a perspective view of a tool usable in accordance with the invention.
Figure 2:
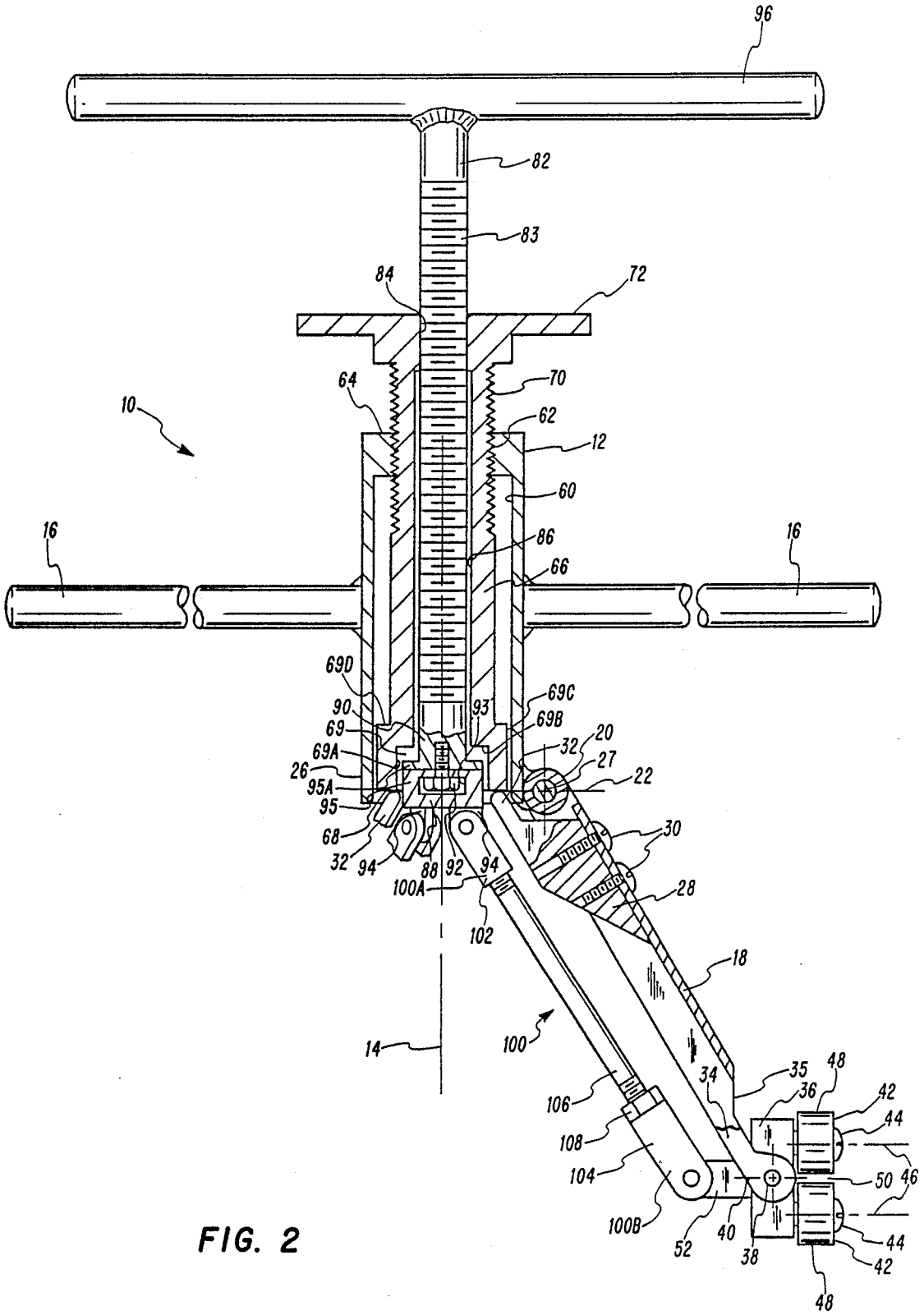
FIG. 2 is an elevational view, partially in section, and partially broken away, of the tool of FIG. 1.

Referring initially to FIGS. 1 and 2, flange-forming tool 10 includes a body 12 which has circular cross-sections about central axis 14. Handles 16 extend preferably radially outwardly from the exterior of body 12. Three legs 18 of equal length depend from body 12 and are pivotally attached to body 12 by way of journals 20, fasteners 22 and opposed, apertured arms 24 formed with each leg 18. Journals are welded to the lower portion 26 of body 12 and have interior walls sized larger than fasteners 22 to permit free, pivoting movements of legs 18 about leg axes 27. The journals 20, preferably, are spaced about 120 degrees apart around lower portion 26.

Each leg 18 preferably has a U-shaped cross-section being concave in a downward and inward direction as shown in FIGS. 1 and 2. At the upper end of each leg 18, a finger member 28 is fastened to the inner central portion of each leg 18 by way of fasteners 30. Each finger member 28 includes a finger 32 projecting upwardly therefrom and being substantially parallel to the longitudinal axis of leg 18. Opposed, apertued arms 34 are formed in the lower ends of legs 18 about a cut-out 35 formed between arms 34. Roller supports 36 are pivotally connected to arms 34 by way of pins 38 for free, pivotal movements about roller support axes 40 and within cut-out 35. The leg axes 27 and roller support axes 40 are horizontal, parallel and spaced apart by the approximate length of legs 18.

Each roller support 36 supports a pair of rollers 42 by way of fasteners 44. Each pair of rollers 42 is free to rotate about parallel, spaced-apart roller axes 46 which lie in a plane that includes the longitudinal axis of the leg 18 and central axis 14 and is perpendicular to the roller support axis 40. The outer surfaces 48 of the rollers 42 are spaced apart to form a material-receiving gap 50. Each roller support 36 also includes an inwardly-extending arm 52.

Body 12 is a substantially cylindrical, hollow member having an interior cylindrical wall 60. Interior threads 62 are provided in the upper wall 64 of body 12. Threads 62 are coaxial with central axis 14 of body 12. An equalizing member 66 extends through cylindrical wall 60 of body 12, terminating at a contact surface 68. Contact surface 68 is a planar, horizontal surface, substantially perpendicular to the central axis 14.

Contact surface 68 is the lowermost surface of an enlarged-diameter mouth 69 at the lowermost end of equalizing member 66, the mouth 69 being formed by inner cylindrical wall **69*a* and inner upper mouth wall 69*b*. Exterior cylindrical wall 69c and exterior upper mouth wall 69d form the exterior of equalizing member 66 in the vicinity of mouth 69. Walls 69*a* and 69c are coaxial with central axis 14, and walls 69*b* and 69*d* are parallel to contact surface 68**.

Exterior threaded surface 70 on equalizing member 66 threadedly engages threads 62 of upper wall 64, such that the equalizing member 66 may be translated with respect to body 12 by rotating the equalizing member 66. An enlarged-diameter disk 72 is provided at the top of equalizing member 66 to facilitate the rotation of the equalizing member 66. Contact surface 68 contacts the preferably rounded ends of fingers 32 at points located between the central axis 14 and the leg axis 27 of each leg, and thereby limits the inward pivotal movements of the legs 18 with respect to the body 14.

An angle-adjusting member 82 has exterior threads 83 which engage the interior threads 84 formed at the upper end of the equalizing member 66. Angle-adjusting member 82 extends throughout a central cavity formed by interior cylindrical wall 86 in equalizing member 66 and walls 69*a* and 69*b* of mouth 69. Threads 83, threads 84, and wall 86 are coaxial with central axis 14. A pivot body 88 is rotatably connected to the lower end 90 of angle-adjusting member 82 by way of a fastener 92 within cavity 93, such that pivot body 88 is free to rotate or swivel about central axis 14. Three apertured arms 94 depend from the lower surface of pivot body 88. Pivot body 88 includes an exterior cylindrical wall 95, which is aligned with a shoulder 95*a* on the lowermost end of angle-adjusting member 82. Wall 95 preferably has a diameter larger than that of threads 83 to accommodate fastener 92 within cavity 93 and to also accommodate arms 94 of suitable dimensions to withstand the forces involved in operation of the tool. In preferred form, mouth 69 in the lowermost end of equalizing member 66 is provided to accommodate the enlarged-diameter pivot body 88 as just described. Bar 96 is attached to the top of angle-adjusting member 82 to serve as a handle as described more fully herinbelow.

Link assemblies 100 extend between roller supports 36 and pivot body 88. Each link assembly 100 includes at its upper end 100*a*, a yoke 102 pivotally attached to one of the arms 94 of pivot body 88 and at its lower end 100*b*, a yoke 104 pivotally attached to an arm 52 of a roller support 36. A threaded rod 106 extends between yoke 102 and yoke 104 of each link assembly 100, and a lock nut 108 is provided to secure and fix the lengths of each link assembly 100 in conventional fashion.

Figure 3:
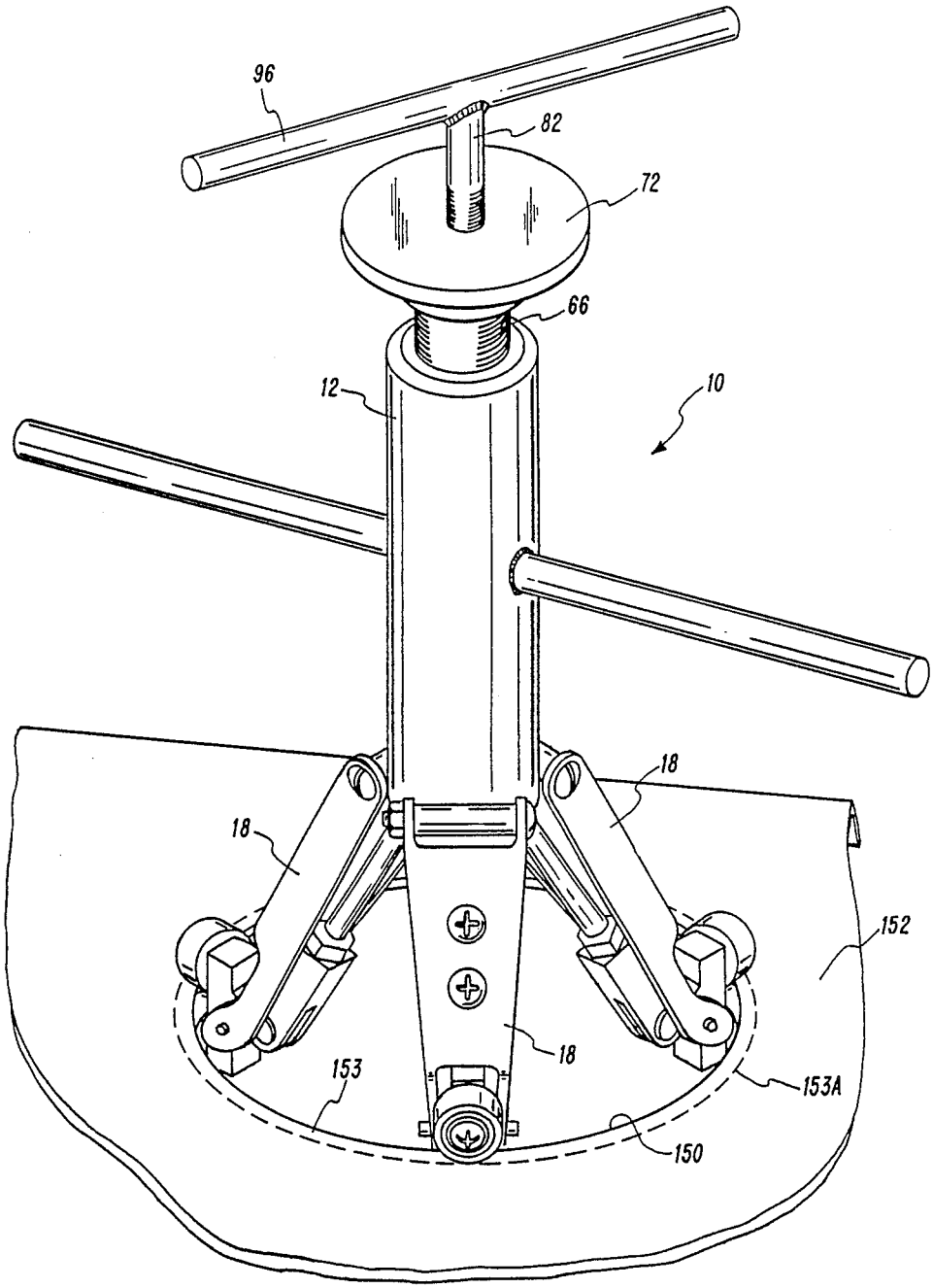
FIG. 3 is a perspective view of the tool of FIG. 1, shown engaged with a circular opening about which a conical flange is to be formed; and, FIGS. 4A and 4B are enlarged, partial side views of a flange-forming member of the tool of the present invention being used to form a conical flange.
Figure 4A:
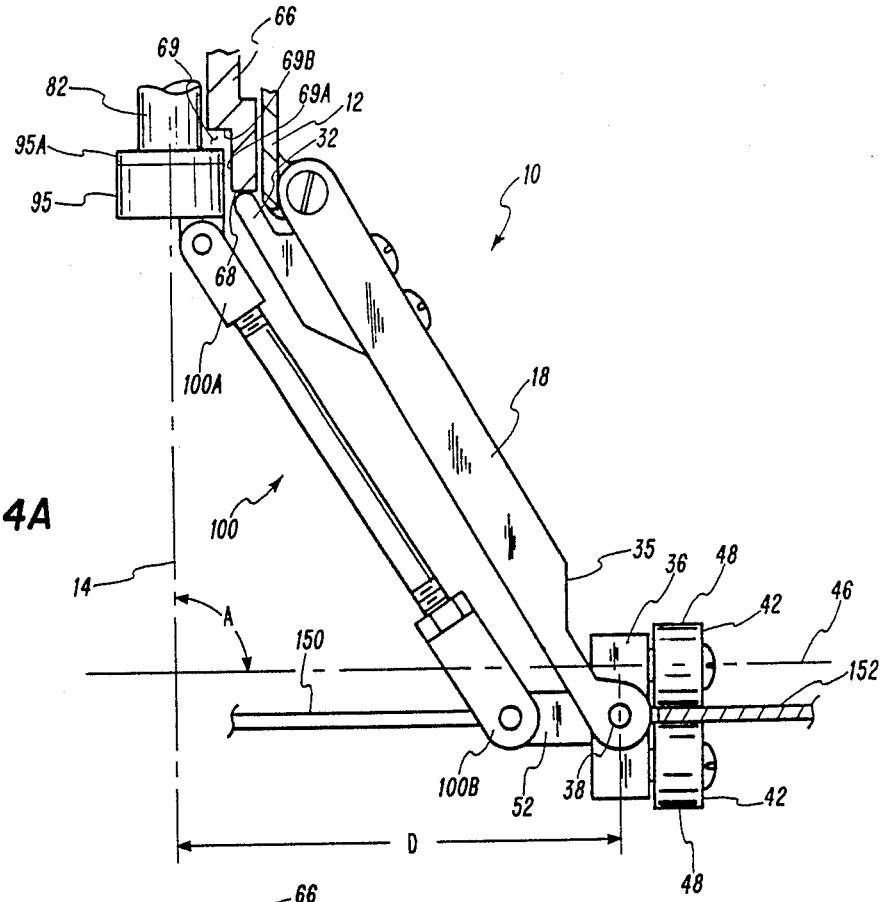

In operation, as shown in FIG. 3, tool 10 is usable for forming a conical flange about a circular opening 150 in sheet material 152. Sheet 152 is made from a malleable material, such as aluminum, in which circular opening 150 has previously been cut. Tool 10 is first partially collapsed by rotating disk 72 to translate equalizing member 66 upwardly with respect to body 12. Upward translation of equalizing member 66 causes contact surface 68 and the ends of fingers 32 to translate upwardly, which in turn allows legs 18 to pivot inwardly. It will be understood that the tool 10 must be initially collapsed sufficiently to allow the lower rollers 48 to pass through opening 150. Angle-adjusting member 82 is then rotated by way of handle 96 to adjust the angular position of roller supports 36 such that gaps 50 are approximately aligned with the plane of sheet 152. Then, disk 72 is turned in the opposite direction from before in order to translate equalizing member 66 downwardly, thereby pivoting the legs 18 outwardly to permit the outer surfaces 48 of rollers 42 to fully engage circular opening 150 in a material-opposing relationship with annular portion 153 of sheet 152, as shown in FIGS. 3 and 4A. Minimum radial distance D (FIG. 4A) between each roller support axis 38 and central axis 14 is thus variable by translating equalizing member 66 with respect to body 12. Contact surface 68, being planar and perpendicular to central axis 14, equalizes the minimum radial distance D for each leg 18 throughout the range of travel of equalizing member 66. Thus, once the annular portion 153 is fully engaged by the material-opposing outer surfaces 48 of rollers 42, central axis 14 of the tool 10 is aligned over the center of opening 150.

Figure 4B:
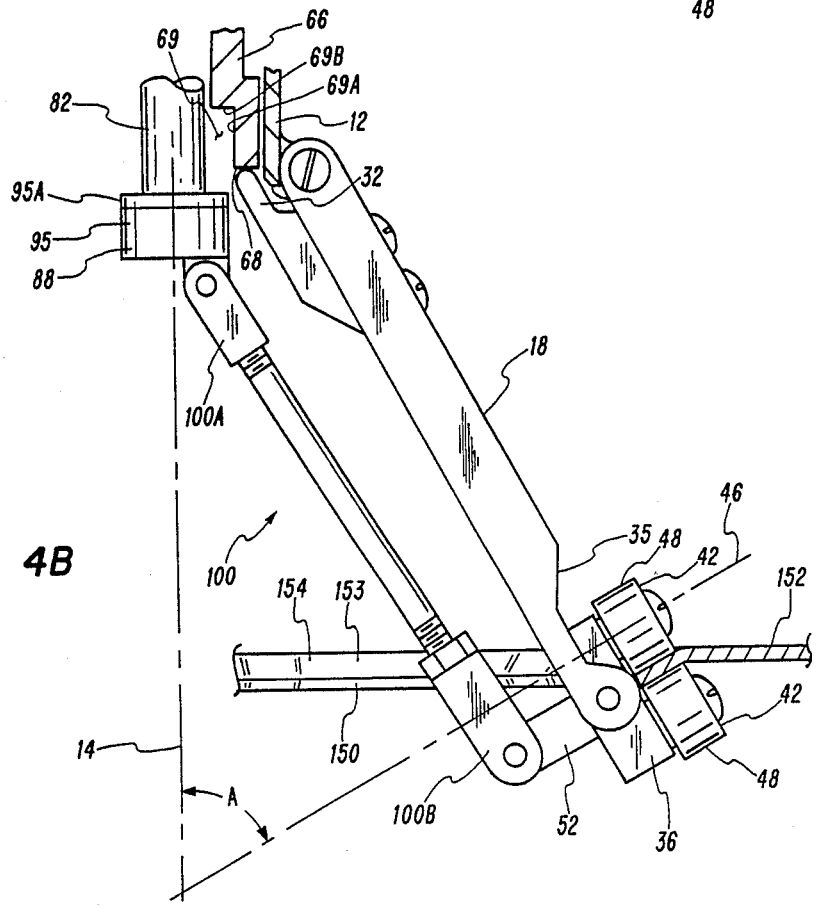

Angle A in FIG. 4A and FIG. 4B denotes the angle of intersection between the roller axes 46 and central axis 14. Initially, roller axes 46 are parallel to sheet 152 in order to allow the engagement of gaps 50 with annular portion 153. Once the tool is engaged, as described above, angle-adjustment member 82 is translated downwardly with respect to equalizing member 66 by rotating handle 96 in the appropriate direction. Handle 96 provides mechanical advantage to aid in the translation of angle-adjustment member 82. Downward translation of angle-adjustment member 82 applies a rotational force to roller support 36, through pivot body 88, link assemblies, 100 and arms 52, such that angle A is decreased, as shown in FIG. 4B. The material-opposing surfaces 48 of the rollers 42 are thereby biased in the direction of the desired conical flange 154 shown in FIG. 4B.

The flange 154 is at least partially formed thereafter by translating surfaces 48 across annular portion 153 thereby displacing and deforming annular portion 153. This step is accomplished by applying torque to handles 16 attached to body 12, which effects rotation of the entire tool 10 without disturbing the relationships between body 12, equalizing member 66 and angle-adjustment member 82. Once the tool 10 has been rotated at least approximately 120 degrees, such that the partial conical flange 154 is completely formed in annular portion 153, the tool 10 will rotate freely due to the lack of any resistance from the now deformed annular portion 153. Additional rotational force may then be applied to roller supports by 36 by way of handle 96 to further decrease angle A and again bias the material-opposing surfaces 48 in the direction of the desired conical flange. Torque may then again be applied by way of handles 16 to rotate the entire tool 10 and further deform and displace annular portion 153. An incremental approach in forming the flange 154, as just described, reduces the amount of torque required to be applied in each step, which thereby enables use of the tool 10 in a highly controlled fashion.

The tool 10 is adaptable to wide variations in opening 150 diameters sheet 152 thicknesses and angular displacements and widths of finished flanges 154. The lengths of links assemblies 100 may be adjusted by varying the locations of yokes 102 and 104 on threaded rods 106, in the event that radical angles A of intersection are required. It will be understood that the final angle A of an operation is determinitive of the angular displacement of a finished flange 154. Cut-outs 35 are provided to accommodate roller supports 36 throughout the anticipated ranges of opening 150 diameters and angles A. Variations in sheet 152 thicknesses may be accommodated by providing a selection of rollers 42 for use with the tool having different diameters of surfaces 48, such that the dimension of gap 50 is variable by the selection of rollers 42. Variations in the desired width of anular portions 153, which determines the width of the finished flanges 154, may be accommodated by providing a selection of rollers 42 having different widths of surfaces 48.

The present invention provides a hand tool for forming conical flanges having substantial advantages over the prior art stamping operation using heavy, specialized, and expensive equipment. Flanges of varying dimensions and angular displacements may be formed in materials of varying thicknesses in an efficient and economical manner using the tool. The tool is hand-operated and relatively inexpensive, such that flanges may now be formed in field locations remote from the original place of manufacture of such things as aircraft ribs and spars.

While a specific embodiment of the present invention has been described in detail herein and shown in the accompanying drawings, it will be evident that various further modifications are possible without departing from the scope of the invention.

I claim:

1. Apparatus for forming a conical flange about a circular opening in malleable planar sheet material, comprising:

a central body;

a plurality of flange-forming members connected to the central body for engagement with an annular portion of the material defining the opening in a material-opposing relationship, each of the flange-forming members including opposed rollers having surfaces for engaging opposite sides of the annular portion of the material;

means for translating the flange-forming members with the central body across the annular portion while maintaining the material-opposing relationship; and means for varying the angular positions of the flange-forming members with respect to the annular portion of the material such that a conical flange is formed therein when the members are translated.

2. The apparatus of claim 1 wherein the flange-forming members are attached to legs pivotally depending from the central body.

3. The apparatus of claim 2 further including means for limiting the inward pivotal movement of the legs with respect to the central body in order to adapt the apparatus for use with openings of variable sizes.

4. The apparatus of claim 1 wherein the means for translating includes a means for applying torque to the central body.

5. A method for forming a conical flange about a circular opening in malleable planar sheet material, comprising the steps of:

engaging an annular portion of the material which defines the opening with at least one pair of opposed surfaces on opposite sides of the annular portion;

applying rotational force to the opposed surfaces in order to initially bias the surfaces in the direction of the desired conical flange; and translating the opposed surfaces across the annular portion thereby displacing and deforming the annular portion to form at least a partial conical flange.

6. The method of claim 5 further comprising the steps of:

applying additional rotational force to the material-opposing surfaces in order to further bias the surfaces in the direction of the desired conical flange; and further translating the material-opposing surfaces to further displace and deform the material.

7. Apparatus for forming a conical flange about a circular opening in malleable sheet material, comprising:

a plurality of pairs of material-opposing rollers;

each pair of rollers being fixed to a roller support for rotation about parallel, spaced apart roller axes;

the outer surfaces of each roller pair being spaced apart to form a material-receiving gap for receiving the sheet material therein;

a plurality of legs of substantially equal length, each leg having first and second ends;

each roller support being pivotally connected to a first end of a leg for movements about a roller support axis;

each leg being pivotally connected at its second end to a body for movement about a leg axis, the body having a central axis;

the leg axis and roller support axis for each leg being parallel and spaced apart by substantially the length of the leg, such that the legs depend downwardly and outwardly from the body and are pivotable to vary the radial distances between the roller support axes and the central axis of the body;

the roller axes being coplanar with the central axis, such that the angles of intersection between the roller axes and the central axis are variable by pivotal movements of the roller supports about the roller support axes;

equalizing means with the body for fixing equal minimum radial distances between the roller support axes and the central axis of the body;

angle-adjusting means with the body for adjusting the angles of intersection between the roller axes and the central axis of the body; and torque applying means for applying torque to the body for rotation about the central axis.

8. The apparatus of claim 7 having three pair of material-opposing rollers and three legs.

9. The apparatus of claim 7 wherein the torque applying means comprises at least two handles extending radially outwardly from opposite sides of the body.

10. The apparatus of claim 7 wherein the equalizing means is adjustable to permit variable minimum radial distances between the roller support axes and the central axis of the body.

11. The apparatus of claim 16 wherein the equalizing means comprises:

a finger extending from the second end of each leg and terminating at an end located between the central axis and the leg axis of that leg; and an equalizing member being axially translatable with respect to the body and having a contact surface for contacting the finger ends and for selective pivotal movement of the legs.

12. The apparatus of claim 11 wherein:

the equalizing member has exterior threads engaged with interior threads of the body, such that the equalizing member is axially translated with respect to the body by rotating the equalizing member relative to the body, the interior and exterior threads being coaxial with the central axis; and the contact surface is a planar lower surface of the equalizing member which is substantially perpendicular to the central axis.

13. The apparatus of claim 7 wherein the angle-adjusting means permits varying the intersecting angles.

14. The apparatus of claim 13 wherein the angle-adjusting means comprises:

a plurality of rigid links having two ends, each link being pivotally connected at one end to one of the roller supports at a position offset from the roller support axis; and each link being pivotally connected at the other end to an angle adjusting member, the angle-adjusting member being axially translatable with respect to the body to adjust the angles of intersection.

15. The apparatus of claim 14 wherein the angle-adjusting member has an exterior threaded surface engaged with an interior threaded surface fixable with respect to the body, and the links' other ends are connected to a pivot body rotatably connected to the angle-adjusting member.

16. The apparatus of claim 13 wherein the angle-adjusting means comprises:

a plurality of rigid links having two ends, each link being pivotally connected at one end to one of the roller supports at a position offset from the roller support axis; and each link being pivotally connected at the other end to an angle adjusting member, the angle-adjusting member being axially translatable with respect to the body to adjust the angles of intersection.

17. The apparatus of claim 16 wherein the angle-adjusting member has an exterior threaded surface engaged with an interior threaded surface fixable with respect to the body, and the links' other ends are connected to pivot body rotatably connected to the angle-adjusting member.

18. Apparatus for forming a conical flange about a circular opening in malleable sheet material, comprising:

a central body;

a plurality of flange-forming members with the central body for engagement with an annular portion of the material about the opening in a material-opposing relationship, the flange-forming members being attached to legs pivotally depending from the central body;

means for translating the flange-forming members with the central body across the annular portion while maintaining the material-opposing relationship;

means for varying the angular positions of the flange-forming members with respect to the angular positions of the material such that a conical flange is formed therein when the members are translated;

means for limiting the inward pivotal movement of the legs with respect to the central body in order to adapt the apparatus for use with openings of variable sizes; and the means for limiting including an equalizing member that is translatable with respect to the central body, and the legs including means for contacting the equalizing member, such that inward pivotal movements of the legs are limited.

19. Apparatus for forming a conical flange about a circular opening in malleable sheet material, comprising:

a central body;

a plurality of flange-forming members with the central body for engagement with an annular portion of the material about the opening in a material-opposing relationship, the flange-forming members being attached to legs pivotally depending from the central body, and the flange-forming members being disposed on supports pivotally mounted to the legs;

means for translating the flange-forming members with the central body across the annular portion while maintaining the material-opposing relationship; and means for varying the angular positions of the flange-forming members with respect to the annular portion of the material such that a conical flange is formed therein when the members are translated, the means for varying including adjustment means for variably fixing the angular relationship of the supports to the legs.

20. The apparatus of claim 19 wherein the adjustment means includes a plurality of links, each having a first and second end, the first end being connected to one of the supports, and the second end being connected to an angle-adjustment member that is translatable with respect to the central body.

* * * * *